US006519902B1

(12) United States Patent
Scissom

(10) Patent No.: US 6,519,902 B1
(45) Date of Patent: Feb. 18, 2003

(54) HEAVY-DUTY FLOOR PANEL FOR A RAISED ACCESS FLOOR SYSTEM

(75) Inventor: James D. Scissom, Summerville, SC (US)

(73) Assignee: Maxcess Technologies, Inc., Summerville, SC (US)

( * ) Notice: Subject to any disclaimer, the term of this patent is extended or adjusted under 35 U.S.C. 154(b) by 0 days.

(21) Appl. No.: 09/970,678

(22) Filed: Oct. 5, 2001

(51) Int. Cl.[7] ..... E04B 5/58

(52) U.S. Cl. ..... 52/126.4; 52/126.6; 52/263; 52/630; 52/220.5

(58) Field of Search ..... 52/263, 126.6, 52/630, 220.5

(56) References Cited

U.S. PATENT DOCUMENTS

| | | | | |
|---|---|---|---|---|
| 2,867,301 A | | 1/1959 | Benton | |
| 3,025,934 A | | 3/1962 | Spiselman et al. | |
| 3,157,254 A | | 11/1964 | Spiselman et al. | |
| 3,279,134 A | | 10/1966 | Donovan | |
| 3,295,272 A | | 1/1967 | Kanno | |
| 3,420,012 A | | 1/1969 | Liskey, Jr. et al. | |
| 3,460,446 A | | 8/1969 | Finsterwalder et al. | |
| 3,918,222 A | | 11/1975 | Bahramian | |
| 4,279,966 A | | 7/1981 | Wakana et al. | |
| 4,438,610 A | * | 3/1984 | Fifer | 52/126.6 |
| 4,745,715 A | * | 5/1988 | Hardwicke et al. | 52/126.6 |
| 4,825,603 A | | 5/1989 | Hardwicke et al. | |
| 4,833,845 A | | 5/1989 | Brückner et al. | |
| 4,843,781 A | | 7/1989 | Chase, III | |

(List continued on next page.)

FOREIGN PATENT DOCUMENTS

| | | | |
|---|---|---|---|
| GB | 1042123 | | 9/1966 |
| GB | 2227035 A | | 7/1990 |
| JP | 5133080 | | 5/1993 |
| JP | 5239903 | | 9/1993 |
| JP | 9067922 | | 3/1997 |
| JP | 10280650 | | 10/1998 |
| JP | 11050646 | * | 2/1999 |
| JP | 11090562 | | 4/1999 |
| JP | 11093385 | | 4/1999 |

*Primary Examiner*—Carl D. Friedman
*Assistant Examiner*—Basil Katcheves
(74) *Attorney, Agent, or Firm*—Morgan, Lewis & Bockius LLP

(57) ABSTRACT

A heavy-duty floor panel for use in an elevated floor system that includes a top, bottom and plurality of sides defining an outer perimeter of the floor panel. A plurality of reinforcing structures may extend from the bottom and be arranged in a pattern to optimize the strength-to-weight ratio of the panel. The reinforcing structures may include five series of reinforcing structures. The first series of reinforcing structures may have a first, substantially constant height, be disposed adjacent to the outer perimeter of the floor panel, and may have a thickness that varies along their length. The second series of reinforcing structures may have a second, substantially constant height different from said first height, be disposed inwardly from said first series of reinforcing structures, and may also have a thickness that varies along their length. The third series of reinforcing structures may have a third height substantially equal to the second height, and be spaced inwardly from the second series of reinforcing structures. The fourth series of reinforcing structures may extend across the panel between at least two of the second series of reinforcing structures. The fourth series of reinforcing structures also may have a height that varies along their length. At least one of the fourth series of reinforcing structures may have a curved portion connected to at least one of the second series of reinforcing structures to reduce stress concentrations. The fifth series of reinforcing structures may extend between and connect the first and second series of reinforcing structures.

16 Claims, 8 Drawing Sheets

U.S. PATENT DOCUMENTS

| | | | | | |
|---|---|---|---|---|---|
| 4,850,163 | A | | 7/1989 | Kobayashi et al. | |
| D306,350 | S | | 2/1990 | Hardwicke et al. | |
| 4,901,490 | A | * | 2/1990 | Zinniel et al. | 248/346.5 |
| 4,922,670 | A | * | 5/1990 | Naka et al. | 52/126.6 |
| 5,074,085 | A | | 12/1991 | Ueda | |
| 5,228,252 | A | | 7/1993 | Nehls | |
| D350,613 | S | | 9/1994 | Fahy, Jr. | |
| 5,402,617 | A | * | 4/1995 | Daw et al. | 52/220.5 |
| 5,791,096 | A | * | 8/1998 | Chen | 52/126.6 |
| 5,953,870 | A | * | 9/1999 | Jette | 52/220.1 |
| 6,101,768 | A | * | 8/2000 | Springstead et al. | 52/126.6 |
| 6,155,013 | A | | 12/2000 | Kim | |
| 6,256,952 | B1 | * | 7/2001 | Fahy et al. | 52/126.6 |

* cited by examiner

HEAVY-DUTY FLOOR PANEL FOR A RAISED ACCESS FLOOR SYSTEM

BACKGROUND OF THE INVENTION

This invention is directed generally to a raised access floor panel, and more particularly, to a floor panel that has an improved strength-to-weight ratio and compatibility with existing raised access substructures.

Heavy-duty floor panels are commonly used in industrial applications, for example, in clean room environments for making semiconductor chips. Heavy-duty floor panels are required to support heavy static and rolling loads. While heavy-duty floor panels are known in the art, there is a need for floor panels that are stronger and capable of supporting even heavier loads, while at the same time being lighter in weight than conventional heavy-duty panels.

To safely store and ship such heavy-duty floor panels, there is also a need for such a floor panel that can be stacked securely, and preferably without the addition of packing materials between adjacent floor panels. In general, floor panels are stacked face-to-face to prevent damage to the floor panel face. Thus, if more than two panels are to be stacked, understructures of adjoining panels would necessarily contact each other. Conventional floor panels, however, typically have uneven understructures. Thus, it is not possible to securely stack several conventional floor panels without some sort of packing material placed between understructures of adjoining floor panels to make the stack level.

SUMMARY OF INVENTION

The heavy-duty floor panel of the invention meets these needs by providing a panel that is stronger than, but about the same weight as conventional heavy duty panels. In other words, the invention increases the strength-to-weight ratio of currently available heavy-duty floor panels. Additionally, the heavy-duty floor panel of the invention meets the need of being able to be stacked securely and without the need for packing material placed between adjacent floor panels.

In general, the heavy-duty floor panel of the invention meets these needs by providing an understructure having a unique combination of structural members of variable width and height, thereby reducing the overall weight of the panel yet providing increased strength. The invention also solves the problem of stacking several panels by providing spaced inner and outer contact surfaces of a substantially uniform height, which enables level stacking of panels without the need for additional packing material.

More particularly, and in accordance with one specific embodiment of the invention, a heavy-duty floor panel is provided for use in an elevated floor system. The floor panel has a top, bottom and plurality of sides defining an outer perimeter of the floor panel. A plurality of reinforcing structures may extend from the bottom and be arranged in a pattern to optimize the strength to weight ratio of the panel. The reinforcing structures may include five series of reinforcing structures. The first series of reinforcing structures may have a first, substantially constant height, be disposed adjacent to the outer perimeter of the floor panel, and may have a thickness that varies along their length. The second series of reinforcing structures may have a second, substantially constant height different from said first height, be disposed inwardly from said first series of reinforcing structures, and may also have a thickness that varies along their length. The third series of reinforcing structures may have a third height substantially equal to the second height, and be spaced inwardly from the second series of reinforcing structures. The fourth series of reinforcing structures may extend across the panel between at least two of the second series of reinforcing structures. The fourth series of reinforcing structures also may have a height that varies along their length. At least one of the fourth series of reinforcing structures may have a curved portion connected to at least one of the second series of reinforcing structures to reduce stress concentrations. The fifth series of reinforcing structures may extend between and connect the first and second series of reinforcing structures.

At least one of the first and second series of reinforcing structures may have a thickness greater in its middle than at its ends. The second and third series of reinforcing structures preferably define spaced level, surfaces upon which other panels may be stacked.

The fourth series of reinforcing structures may be arranged in a grid-like pattern forming a plurality of repeating cells, and there may be at least one additional curved reinforcing structure disposed within at least one of the cells. Preferably, the at least one curved reinforcing structure comprises a plurality of curved ribs dividing the cells into four substantially equal quadrants. The height of the fourth series of reinforcing structures may vary between a maximum height at their middle and a minimum at the ends of each of the fourth series of reinforcing structures to form a generally-pyramidal shape with the third series of reinforcing structures. A plurality of perforations may extend through the floor panel, and may be arranged in a repeating pattern defined at least in part by some of the fourth series of reinforcing structures.

The fifth series of reinforcing structures may also have varying height, and may include curved portions connected to at least one of first and second reinforcing structures to reduce stress concentrations. A sixth series of reinforcing structures may extend between the fifth series of reinforcing structures.

The heavy-duty floor panel of the invention preferably is cast from an aluminum alloy.

According to another aspect of the invention, the heavy duty floor panel of the invention may be part of an elevated floor system for supporting access floor panels. The system may include pedestals having a head for supporting at least one of the heavy-duty floor panels, and may be particularly adapted to replace existing floor panels, e.g., by being formed with an appropriately-sized lip at its outer perimeter. The elevated floor system may include at least one stringer disposed between at least two pedestals and adapted to support a ledge formed by the second and fifth series of reinforcing structures of the floor panel of the invention.

According to yet another aspect of the invention, a method of stacking a plurality of heavy-duty floor panels is provided in which each floor panels has a top, a bottom, a plurality of sides, and a plurality of reinforcing structures extending from the bottom that are arranged in a pattern producing outer and inner spaced, stacking surfaces of substantially uniform height. The method includes the steps of placing the top of a first one of the floor panels against the top of a second one of the floor panels and placing the inner and outer spaced stacking surfaces on the bottom of the second one of the floor panels against the inner and outer spaced stacking surfaces on the bottom of a third one of the floor panels. The step of placing the bottom stacking surfaces of the second panel against the bottom stacking surfaces of third panel may be performed without the use of any packing material therebetween.

Additional features, advantages, and embodiments of the invention may be set forth or apparent from consideration of the following detailed description, drawings, and claims. It is to be understood that the foregoing summary of the invention and the following detailed description are exemplary and intended to provide further explanation without limiting the scope of the invention as claimed.

BRIEF DESCRIPTION OF THE DRAWINGS

The accompanying drawings, which are incorporated herein and constitute part of this specification, illustrate preferred embodiments of the invention, and, together with the general description given above and the detailed description given below, serve to explain the features of the invention.

DETAILED DESCRIPTION OF PREFERRED EMBODIMENTS

Figure 1:
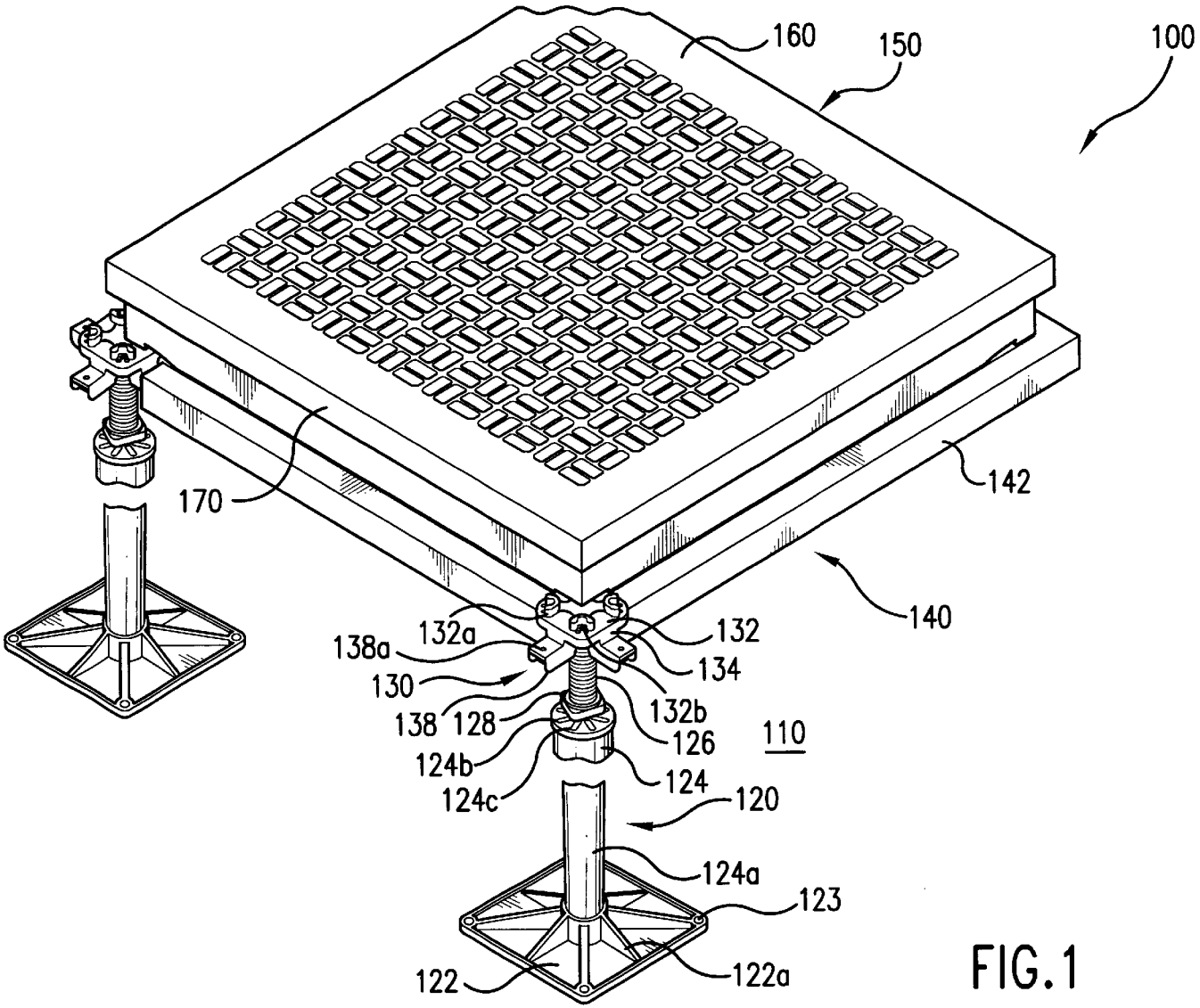
FIG. 1 is perspective view of a portion of a raised access floor system illustrating a pedestal and a corner of a floor panel constructed in accordance with the principles of the invention.

Reference will now be made in detail to preferred embodiments of the invention, examples of which are illustrated in the accompanying drawings. FIG. 1 shows a perspective view of part of a raised access floor system 100 constructed in accordance with a preferred embodiment of the invention. As shown in FIG. 1, the raised access floor system 100 is installed on a subfloor 110 or other supporting surface (not shown). Floor panels 150 are supported by conventional supporting structure. As shown, the supporting structure is of the type having pedestals 120 with pedestal heads 130 and stringers 140 attached to and spanning a distance between the pedestal heads 130. Floor panels 150 of the invention, however, may be used with any other type of supporting structure known in the art.

The supporting structure as shown in FIG. 1 will now be described in detail. In use, pedestals 120 are arranged along the perimeter of the raised access floor system 100. Pedestals 120 can also be arranged in a grid-like pattern with pedestals 120 being spaced substantially equidistant from one another.

Pedestal 120 is preferably an adjustable pedestal of the type designed for heavy-duty applications, e.g., pedestals rated for seismic zones 3 and 4, although any conventional type of pedestal may be used in accordance with the principles of the invention. Pedestal 120 generally includes a base 122 with a post 124 extending from base 122, a rod 126 disposed in the post 124, and a locking device 128, disposed on rod 126 for fixing the height of the pedestal 120 in a predetermined position. The base 122 is shown as being square-shaped but can be a variety of other geometric shapes, including circular or rectangular. The corners of the base 122 may be rounded. The base 122 can include raised or web-like structures 122*a* connecting base 122 with post 124, which is believed to impart greater structural strength of the pedestal 120. Base 122 can rest on or be secured to the subfloor 110 or other supporting surface (not shown). If base 122 is to be secured to the subfloor 110 or other supporting surface (not shown), several anchor holes 123 can be disposed near corners of base 122. Anchor holes 123 can be adapted to accept a variety of anchor devices, including concrete expansion anchors. Alternatively, the base 122 can be secured to the subfloor 110 or other support surface (not shown) by any other method or means known in the art.

The post 124 is rigidly coupled to base 122 and extends substantially perpendicularly therefrom. The post 124 has a lower end 124*a* attached to base 122 and an upper end 124*b* adapted to receive rod 126. The post 124 can be solid or can have a hollow center portion. The cross-section of the post 124 may be a variety of geometric shapes, including circular, rectangular, or square, but as shown in the figures, the cross-section of the post 124 is circular. Post 124 and base 122 can be formed separately or as a unitary whole. If post 124 and base 122 are formed separately, the lower end 124*a* of post 124 can be connected to base 122 by at least one weld (not shown). Alternatively, the lower end 124*a* of post 124 can be connected to the base 122 by providing base 122 with a raised threaded portion (not shown) and the lower end 124*a* of the post 124 with a complementary surface (not shown) adapted to engage the threaded portion of base 122 (not shown). Again, any other means known in the art for making or connecting base 122 and post 124 to form the pedestal 120 may be employed.

If an adjustable height pedestal is employed, rod 126 may be coupled to the upper end 124*b* of post 124 in any number of ways known in the art to provide a lockable, variable length between subfloor 110 or other support surface (not shown) and floor panels 150. For example, in the illustrated embodiment, rod 126 is slidably received within the upper end 124*b* of post 124. The outer surface of the rod 126 is threaded along the entire axial length or a sufficient portion of the axial length of the rod 126 to engage the surface inside the upper end 124*b* of post 124, which receives an end of rod 126. By virtue of the threaded engagement between rod 126 and post 124, rod 126 telescopes within post 124. Thus, the height of pedestal 120 can be adjusted by varying the position of rod 126 with respect to post 124. Once a desired height of the pedestal 120 is obtained, the position of the rod 126 with respect to the post 124 can be fixedly secured in a predetermined position by any of the locking methods known in the art, such as the friction positive locking method or the anti-vibration locking method, which is illustrated in FIG. 1 and briefly described below.

As shown in FIG. 1, the locking device 128 can be a nut. The inner surface of the nut 128 has threads complementary to the threaded surface of rod 126 such that the nut 128 is displaceable along the length of rod 126. The bottom surface of nut 128 may include a number of radial, concave grooves (not shown) adapted to engage a series of convex projections 124*c* that extend from upper end 124*b* of post 124. In this arrangement, nut 128 is fixedly engaged with the upper end 124*b* of post 124 when it is seated on the upper end 124*b* of the post 124, thus fixing the position of the rod 126 with respect to the post 124. Furthermore, the weight of the installed floor panels 50 provides additional compressive loads which act to more fully seat the nut 128 on the post 124. This arrangement prevents rotation of nut 128 by forces such as vibration yet allows for manual re-adjustment. Alternatively, rod 126 can be fixed with respect to post 124 by welding the rod 126 and post 124, or by any other method or means known in the art.

Pedestal head 130 is fixedly connected to rod 126 of pedestal 120 by any means known in the art, such as welding or by providing the pedestal head 130 with a complementary surface (not shown) adapted to engage the threaded surface of rod 126. Alternatively, pedestal head 130 and rod 126 may be formed as a unitary whole. Thus, as described above, the position or height of the pedestal head 130 relative to the subfloor 110 or other support structure (not shown) changes when the height of rod 126 is adjusted within post 124. Pedestal head 130 generally includes a square-shaped base to support the corners of floor panels 150, an upper surface 132, a lower surface 136 and a perimeter sidewall 134 having four sides. The upper surface 132 typically will be substantially flat as illustrated with the exception of four upwardly projecting attaching members 132*a* extending outwardly from corner regions of the upper surface 132. Upwardly projecting attaching members 132*a* may be disposed substantially perpendicular to the upper surface 132 of pedestal head 130 and may be configured to engage corresponding structure on an underside of corners of floor panel 150 as will be described later. Upper surface 132 may also include tap holes 132*b* disposed near attaching members 132*a* to receive a bolt to secure floor panel 150 to floor system 100. Extending outwardly and downwardly from lower surface 136 are four stringer supports 138, one on each side of the pedestal head 130. Each stringer support 138 is adapted to connect with stringer 140. A hole 138*a* of stringer support 138 may be provided to connect the stringer support 138 to stringers 140 with a fastening element. Alternatively, stringer supports 138 may be connected to stringer 140 by welding or any other means or methods known in the art.

As shown, each stringer 140 has a square cross-section. Of course, stringers 140 may be solid or have hollow center regions and may have other cross-sectional geometries. Stringers 140 extend between pedestal heads 130 to form a supporting structure for floor panels 150. Floor panels 150 can rest on or be detachedly coupled to pedestal heads 130 and stringers 140 by fasteners, as is known in the art. The use of both pedestals 130 and stringers 140 provide added structural support to floor panels 150, than does the use of pedestals 130 alone.

Floor panel 150, a portion of which is shown in FIG. 1, is of the type that may be used with conventional supporting structures such as pedestals and may be designed to be readily interchangeable with existing floor panels. Floor panel 150 may be approximately 24" square, but other sized panels may be used according to the principles of the invention. Floor panels 150 may also include holes formed or installed in the corners (not shown) to attach bolts to the pedestal head holes 132*b* to secure floor panel 150 to floor system 100. Such an arrangement is known in the art as a corner lock or corner bolt system, and is particularly suited for seismic applications. As shown, floor panel 150 is of the type having perforations or holes. This provides the advantage of permitting airflow through the floor panels 150. But floor panels 150 need not be perforated, and instead may have a solid surface in accordance with the invention. Floor panel 150 generally has top layer 160, sides 170, and understructure 180 (shown best in FIG. 3).

Figure 2:
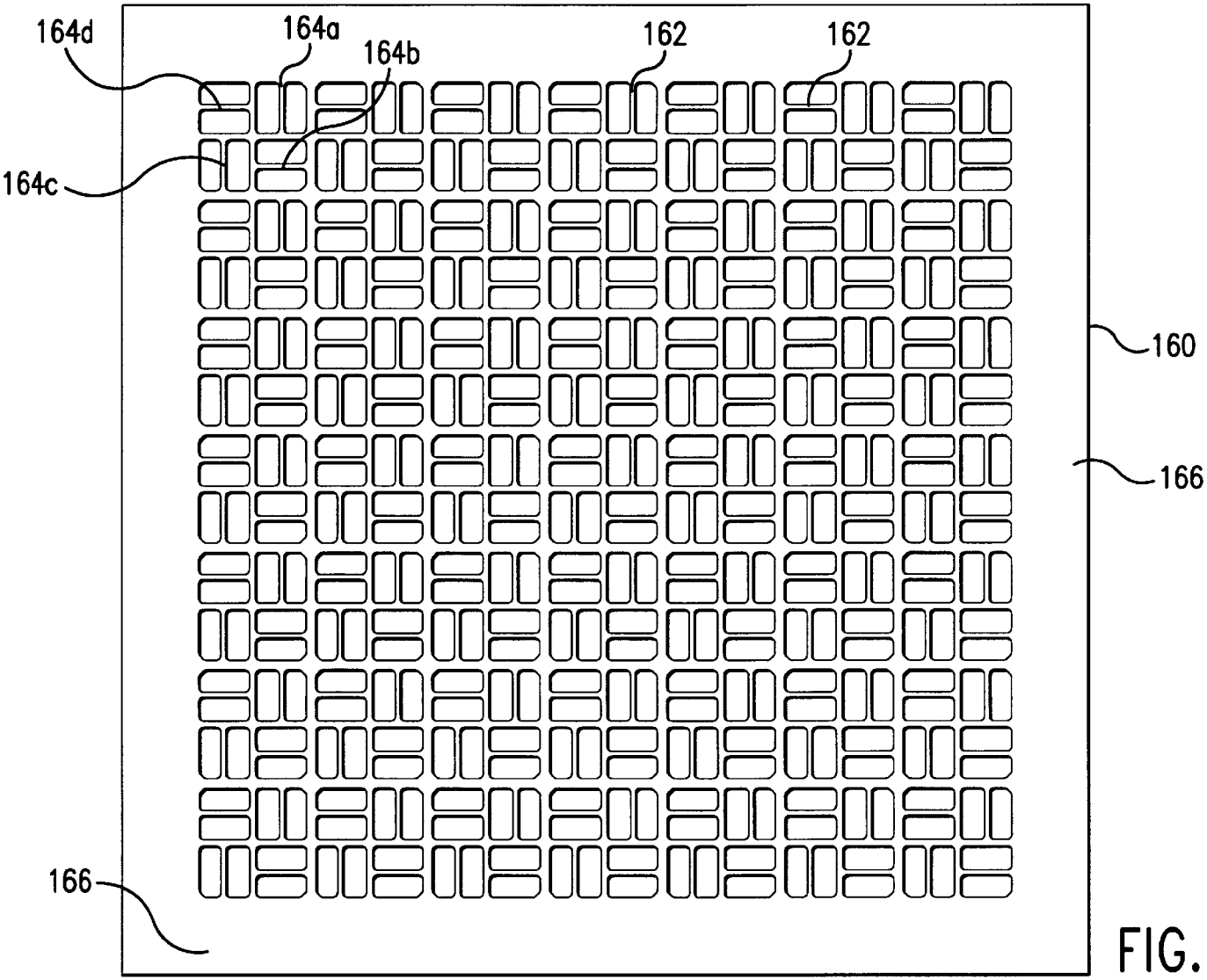
FIG. 2 is a plan view of the top surface of an embodiment of the floor panel partially shown in FIG. 1.
Figure 3:
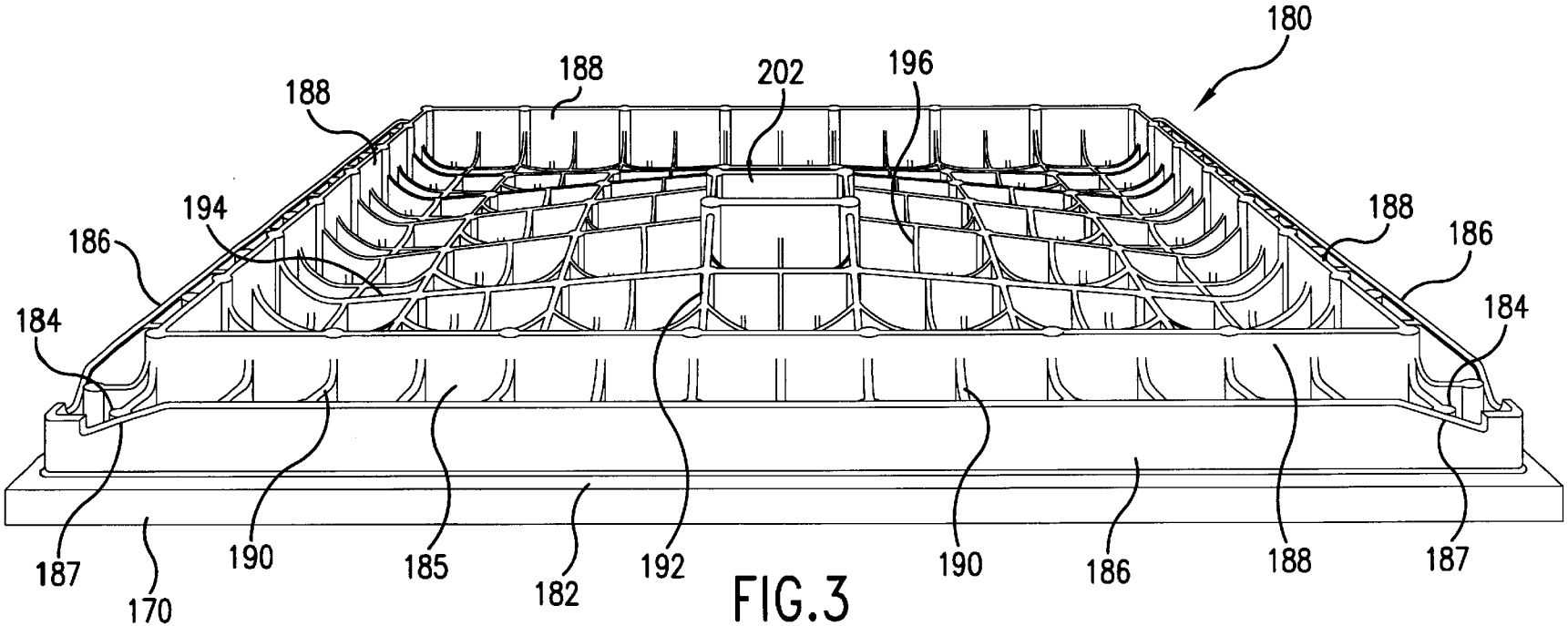
FIG. 3 is a perspective view of the bottom of the floor panel shown in FIG. 2.
Figure 4:
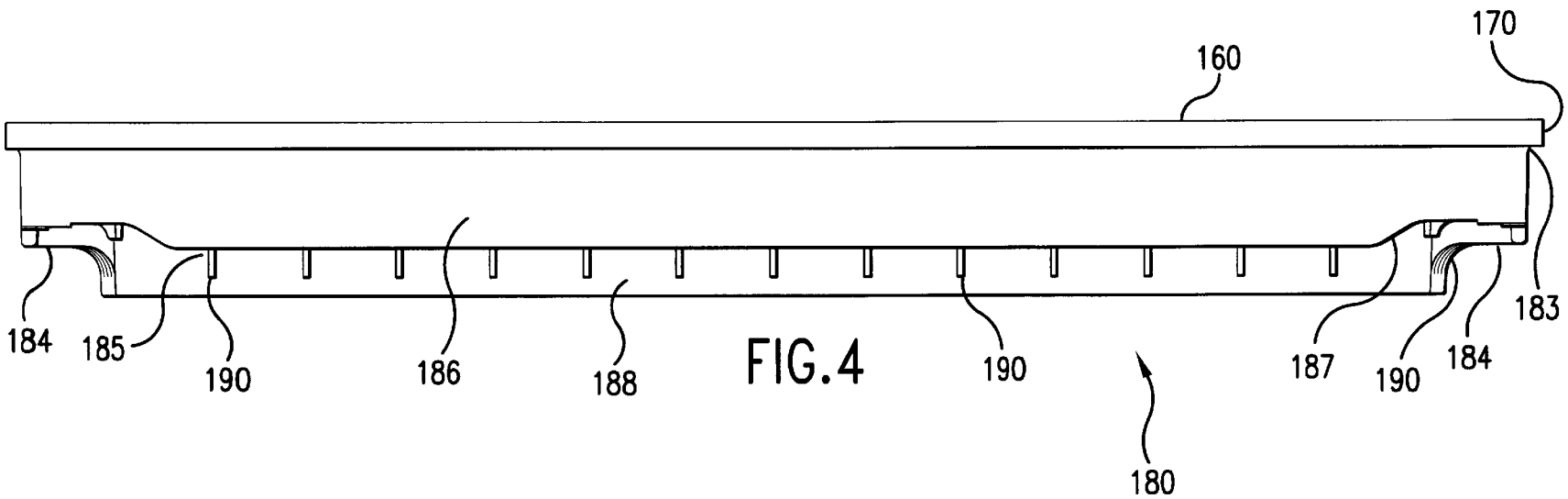
FIG. 4 is a side view of an embodiment of the floor panel shown in FIG. 2.
Figure 5:
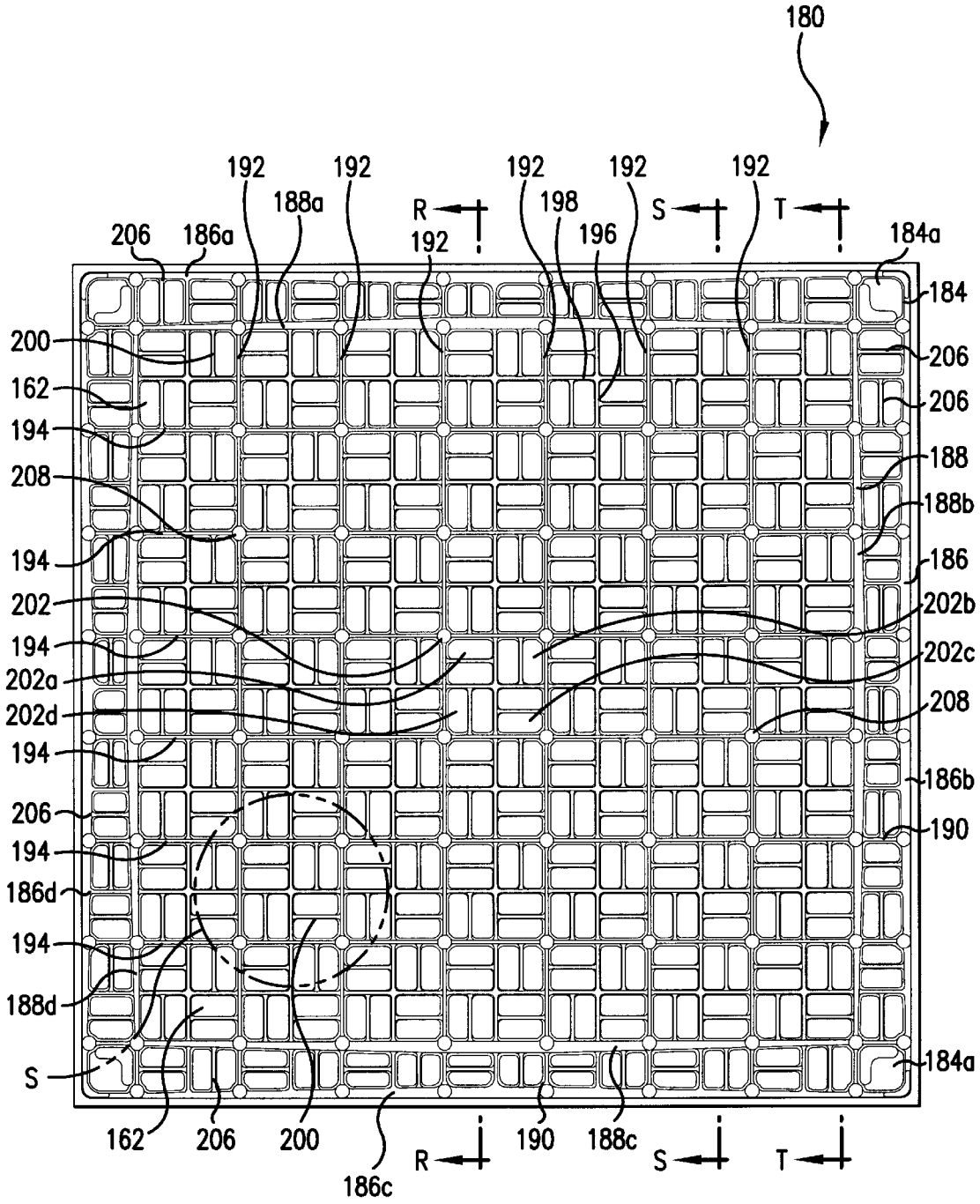
FIG. 5 is a plan view of the bottom of the floor panel shown in FIG. 2.

Referring now to FIGS. 2–8, the details of one floor panel 150 constructed according to the principles of the invention will be described. Floor panel 150 is generally a square-shaped panel, but other shapes are contemplated in accordance with the invention. Referring to FIG. 2, the top layer 160 of floor panel 150 will now be described. Top layer 160 is adapted to support equipment and other heavy loads and constitutes the load-bearing side of floor panel 150. As shown, top layer 160 has a pattern of perforations 162 that pass therethrough and permit airflow through top layer 160 of floor panel 150. Perforations 162 may be formed when floor panel 150 is made, such as during casting if the panel is made from aluminum or other suitable castable material. Alternatively, perforations 162 may be formed by drilling, cutting, or punching a solid top layer 160. As shown, perforations 162 are generally oblong with rounded corners. Perforations 162 may be a variety of geometric shapes. It is believed, however, that oblong perforations provide the greatest amount of airflow through floor panels 150. Perforations 162 may be arranged in a repeating pattern dictated primarily by the understructure 180 as illustrated in FIGS. 3 and 5, for example, to maximize strength and minimize weight as discussed later. The basic pattern includes a pair of perforations 162 disposed substantially parallel with each other. A plurality of these pairs of perforations 162 are disposed in alternating axial and transverse positions across floor panels 150 so that each pair of perforations 162 is substantially perpendicular to adjacent pairs of perforations 162. As used herein, the term "axially" refers to a left-to-right direction when viewing the figures, and the term "transversely" refers to a top-to-bottom direction when viewing the figures. Four pairs of perforations 162 form a repeating series of squares defined by four quadrants 164*a*, 164*b*, 164*c*, 164*d*, with each quadrant including a single pair of parallel perforations 162. Specifically, two perforations 162 are aligned with each other and disposed axially in first quadrant 164*a*, two perforations 162 are aligned with each other and disposed transversely in a second quadrant 164*b*, two perforations 162 are aligned with each other and disposed axially in third quadrant 164*c*, and two perforations 162 are aligned with each other and disposed transversely in fourth quadrant 164*d*. Although perforations 162 are preferably arranged in the pattern shown, other patterns may be used in accordance with the invention. As shown, perforations 162 do not extend to the edge of the panel. A solid perimeter portion 166 is reserved without perforations. The solid perimeter portion 166 provides additional structural strength without unnecessarily limiting the airflow through floor panels 150.

Understructure 180 is described initially with reference to FIGS. 3 and 5. FIG. 3 shows a perspective view of the construction of understructure 180, while FIG. 5 shows a plan view of the configuration of understructure 180. As shown in FIG. 3, understructure 180 includes a number of reinforcing ribs depending downwardly in a substantially perpendicular fashion from top layer 160. Top layer 160 may be slightly larger than understructure 180 such that top layer 160 has a lip 182 (also shown in FIG. 4) extending outwardly around the perimeter of understructure 180. Lip 182 aids in manipulating, handling, and positioning floor panel 150, and may be advantageous to make panel 150 compatible with existing support structures, but is not necessary. Understructure 180 generally includes outer perimeter rib 186, inner perimeter rib 188, and an interior rib 202, each of which may have sides defining a substantially square shape. Inner perimeter rib 188 may be concentrically disposed with outer perimeter rib 186 and interior rib 202 may be concentrically disposed with inner perimeter rib 188. Outer perimeter rib 186 may be inwardly spaced from and adjacent to lip 182 and may also be substantially parallel to side wall 170.

Side wall 170 extends downwardly from and around the perimeter of top layer 160 as shown in FIGS. 1 and 4. Outer perimeter rib 186 extends from understructure 180 to a first height. As shown in FIG. 5, outer perimeter rib 186 has four sides, 186*a*, 186*b*, 186*c*, and 186*d*. The height of outer perimeter rib 186 may be constant over all or the majority of the length of each of its sides.

Inner perimeter rib 188 is spaced inwardly from and may be substantially parallel to outer perimeter rib 186. Inner perimeter rib 188 extends from understructure 180 to a second height. The second height may be approximately twice that of the first height. The height of outer perimeter rib 186 may be lower than that of inner perimeter rib 188, in part, to form a ledge region 185 for disposing floor panel 150 on stringers 140. As shown in FIG. 5, inner perimeter rib 188 has four sides, 188*a*, 188*b*, 188*c*, and 188*d*. The height of inner perimeter rib 188 may be constant over the entire length of each of its sides as shown, or over a majority of its length.

The outer and inner perimeter ribs 186,188 are also shown in FIG. 4, which illustrates a side view of floor panel 150. FIG. 4 shows how floor panels 150 may have a reduced thickness at the four corners 184 to facilitate attachment to pedestal head 130. As shown, the transition between top layer 160 and outer perimeter rib 186 may be a smooth radius 183. In particular, the height of outer perimeter rib 186 may be reduced near corners 184 to form a surface 187 for engaging pedestal head 130. The transition in height between the ends and center portions of outer perimeter ribs 186 may be smooth.

Each of the four corners 184 is adapted to receive a complementary attaching member 132*a* of pedestal head 130 to secure the floor panel 150 to pedestal head 130 as shown in FIG. 1. As shown best in FIG. 5, the corner 184 of outer perimeter rib 186 may be rounded to accept the rounded complementary attaching member 132*a*, which extends into a cavity 184*a* formed by understructure 180 when assembled with floor panel 150.

Figure 6:
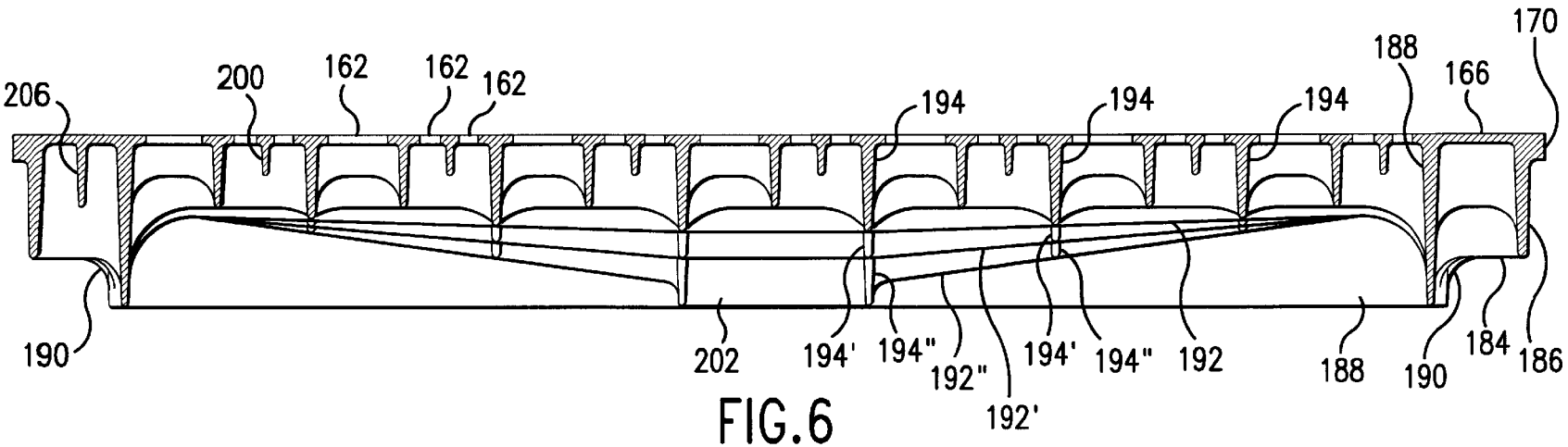
FIG. 6 is cross-sectional view taken along line T—T in FIG. 5.
Figure 7:
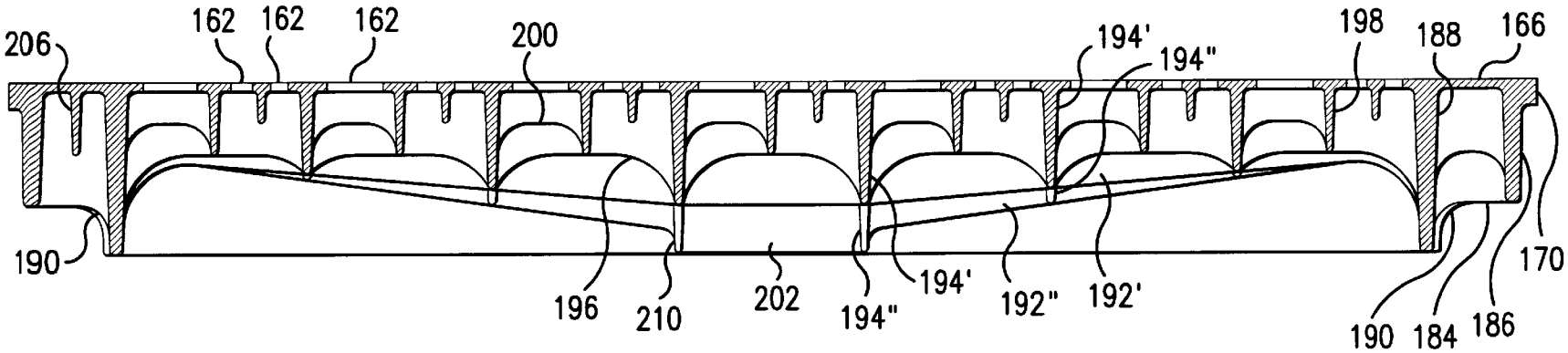
FIG. 7 is cross-sectional view taken along line S—S in FIG. 5.
Figure 8:
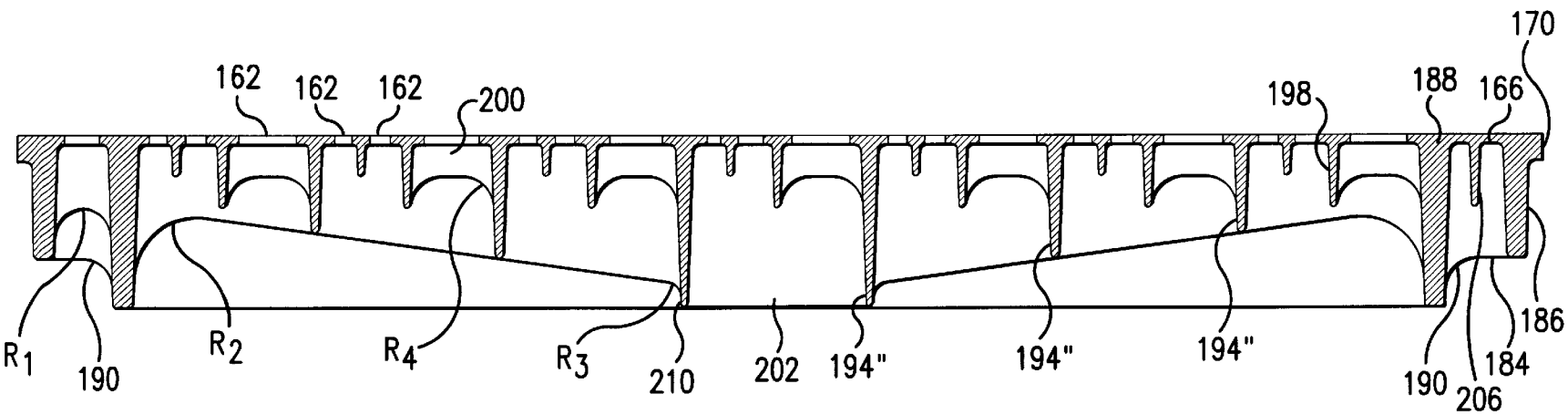
FIG. 8 is cross-sectional view taken along line R—R in FIG. 5.

As shown in FIG. 5, the center portions of one or both outer and inner perimeter ribs 186, 188 may be thicker than the respective end portions. In particular, the thickness of outer perimeter rib 186 may increase gradually from an end portion near corner 184 to the center where the thickness is greatest. The outer surface of outer perimeter rib 186 disposed adjacent to side surface 170 may be straight, i.e., substantially parallel to side surface 170, while the inner surface of outer perimeter rib 186, i.e., the side facing center rib 202, may be curved such that the thickness of outer perimeter rib 186 is greatest at the center and gradually tapers toward the ends. Like outer perimeter rib 186, the inner and outer side surfaces of inner perimeter rib 188 may also be curved or arcuate-shaped, such that the thickness of inner perimeter ribs 188 is greatest at the center and gradually tapers toward the ends near corners 184. The variation in thickness of both outer and inner perimeter ribs 186, 188 may be accomplished in any manner known in the art and is best illustrated by comparing the cross-sectional views of in FIGS. 6–8. For example, outer and inner perimeter ribs 186, 188 are shown thicker in FIG. 7 than in FIG. 6 and thickest in FIG. 8. Additionally, as can be seen in FIGS. 6–8, the thickness of outer and inner perimeter ribs 186, 188 may taper along their respective heights, and each is shown as being thickest near top layer 160 and gradually tapering down in a direction toward the subfloor 110. The variations in thickness, both along the length and along the height of the ribs 186, 188, is designed to impart greatest structural strength where it is needed most, i.e., the center of the span while reducing the weight of these ribs. In other words, this construction improves the strength-to-weight ratio of floor panels 150.

As shown in FIG. 5, interior rib 202 may have four sides, each being parallel to a respective one of the sides of inner perimeter rib 188, and may be disposed in the center of understructure 180 concentrically with inner perimeter rib 188. The height of the interior rib 202 may be the same as the height of inner perimeter rib 188 as best shown with reference to FIG. 8. This construction is beneficial for stacking and shipping. Floor panels 150 are generally stacked for storage and shipping by placing top surfaces of top layer 160 of adjoining floor panels 150 next to one another. The panels 150 are stacked top-to-top to avoid having understructure 180 scratch or mar the top surface of top layer 160. In this arrangement, when more than two floor panels 150 are stacked, understructures 180 of adjacent panels necessarily contact one another. Because inner perimeter rib 188 and center interior rib 202 are at the same height, understructures 180 of adjacent stacked panels contact common, level surfaces. The interior rib 202 provides additional contact surfaces in the center of the panel, which are spaced from the contact surfaces of the edges of the panel formed by inner perimeter rib 188 to provide additional stability. Thus, floor panels 150 may be reliably stacked without having to use packing material between the understructures adjacent floor panels 150 for stability or levelness.

Also shown in FIGS. 3 and 5 are a series of intermediate perimeter ribs 190 disposed between and extending generally perpendicular to outer and inner perimeter ribs 186, 188. The intermediate perimeter ribs 190 extend downwardly from top layer 160. The height of intermediate perimeter rib 190 may vary from outer perimeter rib 186 to inner perimeter rib 188, as shown in FIGS. 3 and 6. The height of each intermediate perimeter rib 190 at the intersection with outer perimeter rib 186 may be at the first height, i.e., the same height as the outer perimeter rib 186. The height of each intermediate perimeter rib 190 at the intersection with inner perimeter rib 188 may be at a third height, approximately intermediate to the first and second heights. The intermediate perimeter rib 190 may have a large, smooth radius, R1 (shown in FIG. 8) which may be on the order of half an inch. Alternatively, intermediate perimeter rib 190 can join outer perimeter 186 and inner perimeter 188 by straight portions instead of smooth radii. It is believed, however, that radii impart greater structural strength while reducing localized stress concentrations. The top layer 160 in the area formed by outer perimeter rib 186, inner perimeter rib 188, and intermediate perimeter rib 190 may be solid, i.e., there are no perforations as shown by solid perimeter 166 in FIG. 2. As shown in FIG. 5, disposed between adjacent intermediate perimeter ribs 190 may be a series of interface ribs 206, which alternate between first and second configurations. In the first configuration the interface rib 206 is disposed in the transverse direction of the panel such that it is perpendicular to and joins outer and inner perimeter ribs 186, 188. In its second configuration, the interface rib 206 is in the axial direction of the panel such that it is disposed parallel to outer and inner perimeter ribs 186,188 and joins adjacent intermediate perimeter ribs 190. Interface ribs 206 also may vary in thickness along their length and/or height.

Referring to FIG. 5, the region of understructure 180 bounded by sides 188*a*, 188*b*, 188*c*, and 188*d* of inner perimeter rib 188 may include additional ribs described as follows. A series of relatively thick ribs may extend between and connect sides 188*a* to 188*c* of inner perimeter rib 188. These ribs are referred to as major ordinate ribs 192. Another series of relatively thick ribs may be disposed substantially perpendicular to major ordinate ribs 192 and may extend between and connect sides 188*b* to 188*d* of inner perimeter rib 188. These ribs are referred to as major abscissa ribs 194. As used herein, the term "ordinate" refers to the top-to-bottom direction when viewing FIG. 5, while the term "abscissa" refers to a left-to-right direction when viewing FIG. 5, such as x and y axes. Major ordinate ribs 192 and major abscissa ribs 194 may extend perpendicularly from top layer 160 and be perpendicular to each other.

Thus, as shown in FIG. 5, the intersection of major ordinate ribs 192 and major abscissa ribs 194 may form a series of squares S, which may correspond to the squares formed by the pattern of perforations 162 on top layer 160 of floor panel 150, as shown in FIG. 2. At every major-ordinate-rib-to-major-abscissa-rib intersection there may be a round node 208. The node 208 may be at the same height of the upper surface of the intersection. Interior rib 202 is the centermost one of the squares S formed by the intersection of major ordinate ribs 192 and major abscissa ribs 194. The structure of each of the squares S will be described below with reference to interior rib 202.

Each square formed on understructure 180 may be further divided into four quadrants 202*a*, 202*b*, 202*c*, 202*d* by a series of quadrant ribs, which may be thinner than major ordinate ribs 192 and major abscissa ribs 194. The thinner quadrant ribs that extend between major ordinate ribs 192 are referred to as minor ordinate ribs 196, because they are parallel to major ordinate ribs 192. The thinner quadrant ribs that extend between major abscissa ribs 194 are referred to as minor abscissa ribs 198 because they are parallel to major abscissa ribs 194. Each quadrant 202*a*, 202*b*, 202*c*, 202*d* is formed by the intersection of minor ordinate ribs 196 and minor abscissa ribs 196 and may contain a pair of perforations 162, corresponding to the pair of perforations 162 in top layer 160. Each pair of performations 162 disposed in quadrants 202*a*, 202*b*, 202*c*, 202*d* may be separated by a perforation rib 200. Perforation rib may extend perpendicularly from top layer 160.

First center square quadrant 202*a* may include a pair of perforations 162 disposed transversely with perforation rib 200 disposed between major ordinate rib 192 and minor ordinate rib 196. Second square quadrant 202*b* may include a pair of perforations 162 disposed axially with perforation rib 200 disposed between major abscissa rib 194 and minor abscissa rib 198. Third square quadrant 202*c* may include a pair of perforations 162 disposed transversely with perforation rib 200 disposed between major ordinate rib 192 and minor ordinate rib 196. Fourth square quadrant 204*d* may include a pair of perforations 162 disposed axially with perforation rib 200 disposed between major abscissa rib 194 and minor abscissa rib 198.

Cross-sectional views of FIG. 5 will now be described, but in doing so it is pointed out that the floor panel 150 may be symmetrical, such that both halves of panel 150 are identical. For example, the construction of the floor panel 150 may be the same on either side of a centerline through the floor panel 150. The cross-sections of FIGS. 6–8 illustrate the rib construction along the lines T—T from just inside inner perimeter rib 188*d* in FIG. 6, further inward along the lines S—S as shown in FIG. 7, and near the center along the lines R—R as shown in FIG. 8. The height of major ordinate rib 192 and major abscissa rib 194 may be greatest near interior square 202 and may gradually taper toward inner perimeter rib 188. Height of square 202 may step up from the height of major axial and longitudinal ribs 192, 194. This is illustrated in FIG. 3 perspectively and in cross-section in FIG. 8 with step 210 between major ordinate rib 192 and upper edge of major abscissa rib 194. Step 210 may be tapered with radii R3 as shown in FIG. 8.

In general each major ordinate rib 192 and each major abscissa rib 194 gradually increases in height toward the center of the panel, i.e., toward interior rib 202 to form therewith a pyramid-like shape. This is illustrated by the series of cross-sections in FIGS. 6–8. As shown in FIG. 5, each major abscissa rib 194 has a height that may increase as shown, for example, in elevations 194, 194', and 194" shown in the cross-section of FIG. 6. Additionally, major abscissa ribs 194 may increase in height from inner perimeter rib 188 to interior square 202 as illustrated best in FIG. 8 with major abscissa ribs 194". Likewise, major ordinate ribs 192 may increase in a gradual slope from inner peripheral rib 188 to interior square 202. Additionally, major ordinate rib 192 may increase in height as shown in elevations, for example, 192, 192', and 192" shown in the cross-section of FIG. 6.

As shown in FIGS. 6–8, large, smooth radii R2 may be formed at intersections of major ordinate rib 192 and inner perimeter rib 188. Large, smooth radii R2 may also formed at intersections of major abscissa rib 194 and inner perimeter rib 188. These radii may be on the order of one inch. Additionally, perforation ribs 200 that connect major abscissa ribs 194 and minor abscissa ribs 198 may also form large, smooth radii, R4 which may also be on the order of one inch. Radii joining minor abscissa ribs 198 to inner perimeter rib 188 may be on the order of one-half inch. As mentioned above, although the rib-to-rib intersections can be straight or can form sharp corners, it is believed that radiussed corners can withstand greater structural loads than straight sections and reduce stress concentrations present in sharp corners. In effect, this provides the strength of a taller structural member without the additional weight of a taller structure.

It is also believed that by gradually increasing the height of major ordinate and major abscissa ribs 192, 194 near the center, i.e., interior square 202, provides greater structural support where it is needed most. The greatest structural strength in a conventional floor panel should be near the edges of the floor panel as the greatest amount of structural support is provided nearest structural supports, such as pedestals 120 and stringers 140. Thus, the least amount of structural strength in a conventional floor panel should be observed farthest from structural supports, i.e., the center of a panel. By gradually increasing the height of major ordinate and major abscissa ribs 192, 194 and near the center of floor panel 150, the center of floor panel 150 can withstand greater structural loads than conventional floor panels where the structural members are of a generally uniform height. It is also believed that tapering widths of the structural members reduce the overall weight of floor panel 150 while maintaining sufficient structural strength. The thicknesses of outer and inner perimeter ribs 186, 188, major abscissa 194, minor abscissa ribs 198, and perforation ribs 200 as shown in FIGS. 6–8 may be greatest at their base near to top layer 160 and gradually taper therefrom.

Applicant performed several load tests on a floor panel constructed according to the embodiment of the invention illustrated in FIGS. 2–8. These tests were performed without stringers. In other words, the floor panels tested were supported only by a pedestal. The results show that the floor panel 150 has a strength-to-weight ratio of about 140.625 (4500 lbs. of load carrying capacity for a 32 lb. panel). Three separate panels were tested and the results given below are averages for the three panels tested. The tests were performed in accordance with Ceilings & Interior Systems Construction Association ("CISCA") recommended procedures for determining concentrated load capacity. The loads were applied using a hydraulic ram on top of a one square inch steel indentor at the center of the panel and at the midpoint of the edge of the panel. A different edge was tested on each panel. The force of the load was measured by using an electronic load cell, and deflection was measured using a dial indicator. Applying loads at the center of the panel yielded the following results:

| Center Deflection (in inches) | Average Applied Load (in pounds) |
|---|---|
| 0.040 | 2012 |
| 0.050 | 2530 |
| 0.060 | 3042 |
| 0.070 | 3552 |
| 0.080 | 4043 |

The loads in the table above were applied to the panels sequentially. After the center deflection of 0.080" was reached, the load was removed from the panels and an average permanent set deflection of 0.003" was observed. Additional loads were then applied to the floor panels with the results summarized in the table below.

Using the same methodology as described above, applying loads at the edge of the panel yielded the following results: After the edge deflection of 0.080" was reached, the load was removed from the panels and an average permanent set deflection of 0.004" was observed. Additional loads were then applied to the floor panels with the results summarized in the table below.

Although the foregoing description is directed to the preferred embodiments of the invention, it is noted that other variations and modifications will be apparent to those skilled in the art, and may be made without departing from the spirit or scope of the invention.

What is claimed is:

1. A heavy-duty floor panel for use in an elevated floor system, said floor panel comprising:

a top, bottom and plurality of sides defining an outer perimeter of said floor panel;

a plurality of reinforcing structures extending from said bottom and arranged in a pattern to optimize the strength-to-weight ratio of the panel, said reinforcing structures including:

a first series of reinforcing structures having a first, substantially constant height and being disposed adjacent to the outer perimeter of said floor panel, said first reinforcing structures having a thickness that varies along their length;

a second series of reinforcing structures having a second, substantially constant height different from said first height and being disposed inwardly from said first series of reinforcing structures, said second reinforcing structures having a thickness that varies along their length;

a third series of reinforcing structures having a third height substantially equal to said second height and being spaced inwardly from said second series of reinforcing structures;

a fourth series of reinforcing structures extending across said floor panel and between at least two of said second series of reinforcing structures, said fourth series of reinforcing structures having a height that varies along their length, at least one of said fourth series of reinforcing structures having a curved portion connected to at least one of said second series of reinforcing structures to reduce stress concentrations; and a fifth series of reinforcing structures having varying height and extending between and connecting said first and second series of reinforcing structures, wherein said fifth series of reinforcing structures include curved portions connected to at least one of first and second reinforcing structures to reduce stress concentrations, and wherein the height of said fifth series of reinforcing structures varies from a maximum proximate said second series of reinforcing structures and a minimum proximate said first series of reinforcing structures to define a ledge configured to rest upon a stringer.

2. The heavy-duty floor panel of claim 1, wherein said reinforcing structures comprise ribs.

3. The heavy-duty floor panel of claim 1, wherein said fourth series of reinforcing structures are arranged in a grid-like pattern forming a plurality of repeating cells.

4. The heavy-duty floor panel of claim 3, further comprising at least one additional curved reinforcing structure disposed within at least one of said cells.

5. The heavy-duty floor panel of claim 4, wherein said at least one curved reinforcing structure comprises a plurality of curved ribs dividing at least one of said cells into four substantially equal quadrants.

6. The heavy-duty floor panel of claim 1, wherein a sixth series of reinforcing structures extend between said fifth series of reinforcing structures.

7. The heavy-duty floor panel of claim 1, wherein the height of said fourth series of reinforcing structures varies between a maximum height proximate the middle and a minimum proximate the ends of each of said fourth reinforcing structures to form a generally-pyramidal shape with said third series of reinforcing structures.

8. The heavy-duty floor panel of claim 1, wherein at least one of said first and second series of reinforcing structures has a thickness greater in the middle than at its ends.

9. The heavy-duty floor panel of claim 1, wherein said second and third series of reinforcing structures define spaced level, surfaces upon which other panels may be stacked.

10. The heavy-duty floor panel of claim 1, further comprising a plurality of perforations extending through said floor panel.

11. The heavy-duty floor panel of claim 10, wherein said plurality of perforations are arranged in a repeating pattern defined at least in part by some of said fourth series of reinforcing structures.

12. The heavy-duty floor panel of claim 1, wherein said top of the floor panel has a greater surface area than said bottom of the floor panel, thereby forming a lip at an interface between the top and bottom.

13. The heavy-duty floor panel of claim 1, wherein said floor panel is formed from an aluminum alloy.

14. The heavy-duty floor panel of claim 13, wherein said panel is cast from said aluminum alloy.

15. An elevated floor system for supporting access floor panels, said system comprising:

pedestals having a head for supporting at least one of a plurality of heavy-duty floor panels, said at least one of said plurality of floor panels including:

a top, bottom and plurality of sides defining an outer perimeter of said floor panel;

a plurality of reinforcing structures extending from said bottom and arranged in a pattern to optimize the strength-to-weight ratio of the panel, said reinforcing structures including:

a first series of reinforcing structures having a first, substantially constant height and being disposed adjacent to the outer perimeter of said panel, said first reinforcing structures having a thickness that varies along their length;

a second series of reinforcing structures having a second, substantially constant height different from said first height and being disposed inwardly from said first series of reinforcing structures, said second reinforcing structures having a thickness that varies along their length;

a third series of reinforcing structures having a third height substantially equal to said second height and being spaced inwardly from said second series of reinforcing structures;

a fourth series of reinforcing structures extending across said panel and between at least two of said second series of reinforcing structures, said fourth series of reinforcing structures having a height that varies along their length, at least one of said fourth series of reinforcing structures having a curved portion connected to at least one of said second series of reinforcing structures to reduce stress concentrations; and a fifth series of reinforcing structures having varying height and extending between and connecting said first and second series of reinforcing structures, wherein said fifth series of reinforcing structures include curved portions connected to at least one of first and second reinforcing structures to reduce stress concentrations, and wherein the height of said fifth series of reinforcing structures varies from a maximum proximate said second series of reinforcing structures and a minimum proximate said first series of reinforcing structures to define a ledge configured to rest upon a stringer.

16. The elevated floor system of claim 15 further comprising:

at least one stringer disposed between at least two of said pedestals, said at least one stringer being adapted to support the ledge formed by said second and fifth series of reinforcing structures of said floor panel.

* * * * *